US008437650B2

(12) United States Patent
Kooriya et al.

(10) Patent No.: US 8,437,650 B2
(45) Date of Patent: May 7, 2013

(54) IMAGE FORMING APPARATUS

(75) Inventors: Takaaki Kooriya, Hachioji (JP); Kimio Nishizawa, Hachioji (JP); Takahiro Kanmaki, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 445 days.

(21) Appl. No.: 12/401,979

(22) Filed: Mar. 11, 2009

(65) Prior Publication Data

US 2009/0232529 A1 Sep. 17, 2009

(30) Foreign Application Priority Data

Mar. 14, 2008 (JP) ..... 2008-065487

(51) Int. Cl.
*G03G 15/06* (2006.01)

(52) U.S. Cl.
USPC ..... 399/55; 399/27; 399/49

(58) Field of Classification Search ..... 399/9, 27, 399/30, 38, 49, 53, 55, 58–60, 72, 74
See application file for complete search history.

(56) References Cited

U.S. PATENT DOCUMENTS

| | | | | |
|---|---|---|---|---|
| 4,462,680 | A * | 7/1984 | Ikeda | 399/58 |
| 5,250,988 | A * | 10/1993 | Matsuura et al. | 399/42 |
| 5,619,308 | A | 4/1997 | Kinoshita et al. | |
| 6,987,934 | B2 * | 1/2006 | Bessho et al. | 399/27 |
| 2005/0232648 | A1 * | 10/2005 | Nishizawa et al. | 399/49 |
| 2006/0269306 | A1 * | 11/2006 | Shimizu | 399/44 |

FOREIGN PATENT DOCUMENTS

| | | | |
|---|---|---|---|
| JP | 5-323743 | A | 12/1993 |
| JP | 2004-37934 | A | 2/2004 |
| JP | 2005-327083 | A | 11/2005 |
| JP | 2007-33571 | A | 2/2007 |

OTHER PUBLICATIONS

Japanese Office Action for Japanese Patent Application No. 2008-065487 mailed Nov. 17, 2009 with English translation.

* cited by examiner

*Primary Examiner* — Walter L Lindsay, Jr.
*Assistant Examiner* — Benjamin Schmitt
(74) *Attorney, Agent, or Firm* — Cantor Colburn LLP

(57) ABSTRACT

An image forming apparatus may include a sensor which detects a density of a patch image formed on an image carrier; an image quality control section which controls an image forming condition based on a detection value of the sensor; and a judging section which judges if the detection value has a tendency of increasing or decreasing, or not, wherein, the image quality control section compensates the image forming condition with a first compensating amount in case when the detection value does not have the tendency of increasing nor decreasing, and compensates the image forming condition with a second compensating amount of which absolute value is larger than an absolute value of the first compensating amount corresponding to the second compensating amount, in case when the detection value has the tendency of increasing or decreasing.

14 Claims, 4 Drawing Sheets

IMAGE FORMING APPARATUS

CROSS REFERENCE TO RELATED APPLICATION

The present application is based on Japanese Patent Application No. 2008-065487 filed with Japanese Patent Office on Mar. 14, 2008, the entire content of which is hereby incorporated by reference.

FIELD OF THE INVENTION

The present invention relates to an image forming apparatus using an electrophotographic process.

BACKGROUND OF THE INVENTION

In an image forming apparatus for forming an image using an electrophotographic process, the image characteristics such as image density are affected by a chronological change of the materials such as a photoreceptor and developer, a change of an ambience, namely, a change in the temperature and humidity, and so on. To solve this problem, attempts have been made to provide image quality control for stabilizing the image quality by corrections conforming to these fluctuating factors.

In Japanese Unexamined Patent Application Publication No. H5-323743, a reference electrostatic latent image called a "patch image" is formed on a photoreceptor by charging and exposure, and the potential of the reference electrostatic latent image is detected and stored. When an image is formed, an electrostatic pattern is formed under the same conditions as those for forming a reference electrostatic latent image, and the image forming conditions are set based on the result of detecting the potential of this electrostatic pattern.

Other documents than Japanese Unexamined Patent Application Publication No. H5-323743 also disclose the aforementioned image quality control technique wherein a reference image is formed, and the potential and density of the formed reference image are detected, whereby the image forming conditions are controlled based on the result of detection.

An effective control method for maintaining a certain image quality level is provided by the image quality control technique disclosed in the Japanese Unexamined Patent Application Publication No. H5-323743 wherein a reference image is formed, and the potential and density of the reference image are detected, whereby the image forming conditions are controlled based on the result of detection.

In this method, however, when the image forming characteristics such as development characteristics have been subjected to a drastic chronological change in a predetermined direction, insufficient correction from the target image quality will be disabled immediately after the change has been corrected. Thus, it has been found out that image quality problems such as density occur.

To be more specific, when there is a drastic change in the environment as exemplified by temperature or humidity or in the page coverage rate of the image, correction fails to catch up with the needs, with the result that a fluctuation in image quality occurs. This problem raises a big concern in printing especially with respect to a plate making phase. Such problems cannot be solved by the conventional arts including the image quality control disclosed in Japanese Unexamined Patent Application Publication No. H5-323743.

The object of the present invention is to provide an image forming apparatus capable of suppressing a change in image quality caused by the chronological change in image forming characteristics, thereby ensuring stable formation of a high-quality image.

SUMMARY

One aspect of the present invention provides an image forming apparatus comprising: an image carrier;

image forming section which forms toner image onto the image carrier;

a sensor which detects a density of a patch image which is formed on the image carrier;

an image quality control section which controls an image forming condition based on a detection value of the sensor; and a judging section which judges if the detection value of the sensor has a tendency of increasing or a tendency of decreasing;

wherein, the image quality control section compensates the image forming condition with a first compensating amount in case when the judging section judges that the detection value does not have the tendency of increasing nor the tendency of decreasing, and compensates the image forming condition with a second compensate amount which has a larger absolute value than the first compensating amount in case when the judging section judges that the detection value has the tendency of increasing or the tendency of decreasing.

DESCRIPTION OF THE PREFERRED EMBODIMENT

The following describes the present invention with reference to the illustrated embodiments, without the present invention being restricted thereto.

[Structure of the Image Forming Apparatus]

Figure 1:
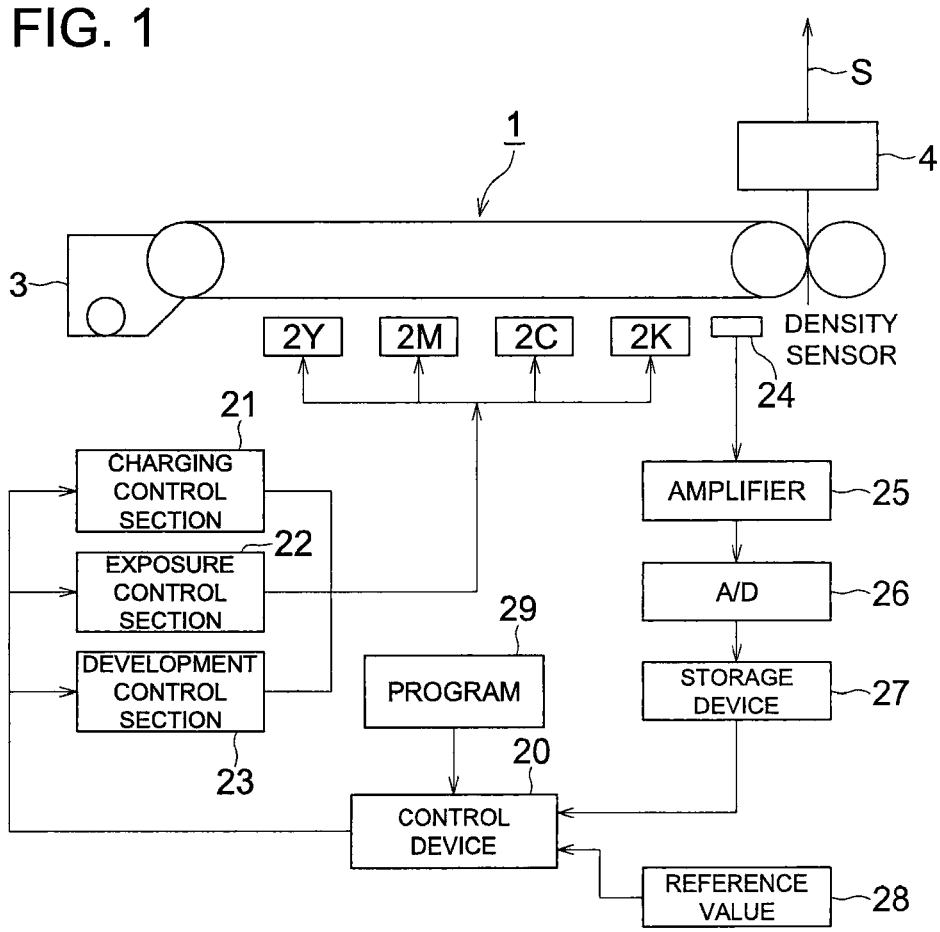
FIG. 1 is a diagram representing an image forming apparatus as an embodiment of the present invention.
Figure 2:
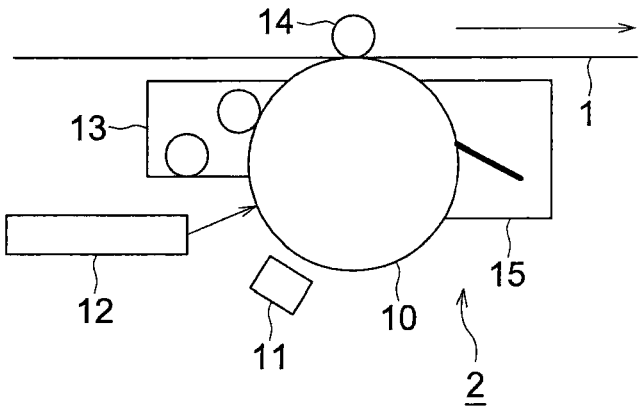
FIG. 2 is a diagram representing an image forming section.

Referring to FIGS. 1 and 2, the following describes the image forming apparatus as an embodiment of the present invention.

FIG. 1 is a diagram representing an image forming apparatus as an embodiment of the present invention. FIG. 2 is a diagram representing the structure of an image forming section.

The image forming apparatus includes an image forming section 2Y for forming a yellow image, an image forming section 2M for forming a magenta image, an image forming section 2C for forming a cyan image, and an image forming section 2K for forming a black image. Using an electrophotographic process, the image forming apparatus forms a color toner image on an intermediate transfer member 1 as an image carrier. Then a color toner image is formed on a recording medium S by transfer.

The color toner image on the recording medium S is fixed by a fixing device 4.

The intermediate transfer member 1 is cleaned by a cleaning device 3 after the recording medium S has been transferred onto the intermediate transfer member 1.

FIG. 2 is a diagram representing the structure of the image forming sections 2Y, 2M, 2C, and 2K of FIG. 1. It should be noted that "2" is used to denote the image forming sections 2Y, 2M, 2C, and 2K.

A charging device 11, exposure device 12, development device 13, transfer device 14, and cleaning device 15 are arranged around the photoreceptor 10. A toner image is formed on the photoreceptor 10 by charging, exposure, and development. A toner image is transferred onto the intermediate transfer member 1 of FIG. 1 by the transfer device 14.

The photoreceptor 10 is cleaned by the cleaning device 15 after the toner image has been transferred thereto.

[Image Quality Control]

The image forming apparatus includes a control section 20. According to the program stored in the program storage device 29, the control section 20 provides the aforementioned image formation control and image quality control to be described below.

Image quality control is executed during the image forming process. Image quality control is also executed when the image forming apparatus is started by turning on the main switch of the image forming apparatus and when the image forming process is started. Further, image quality control is executed when maintenance is performed and the image forming process is implemented.

The image quality control to be described below is provided for each operation of forming for a plurality of sheets of images—e.g., 50 prints. This control is provided during the continuous image forming process in some cases.

As is well known, in the image quality control, a reference electrostatic latent image is formed on a photoreceptor 10 according to the image data of a predetermined density, and development is performed under predetermined image forming conditions, and a reference toner image called the patch image (hereinafter referred to as "patch image") is formed on the intermediate transfer member 1.

The density of the patch image transferred onto the intermediate transfer member 1 is detected by the density sensor 24.

The output of the density sensor 24 having detected the patch image density is amplified by an amplifier 25, and is digitized by an A/D converter 26, and is stored in a detection value storage device 27.

Detection values detected in the image quality control process wherein detection is executed a plurality of times are stored in the detection value storage device 27.

The control section 20 compares the detection value read out of the detection value storage device 27 with the reference value from the reference value generation section 28, and corrects the image forming conditions according to the result of comparison, whereby the image quality is controlled.

This control allows an image of a predetermined level density to be outputted in response to a predetermined level of input density.

The image quality control performs one of the following functions:

(1) Controlling the charging control section 21 for controlling the charging device 11, whereby the charging potential of the photoreceptor 10 is controlled:

(2) Controlling the exposure control section 22 for controlling the exposure device 12, whereby the potential of the electrostatic latent image is controlled; and (3) Controlling the development control section 23 for controlling the development device 13, whereby the toner image density is controlled.

The charging control includes the control of the grid potential of the scorotron charging device.

The exposure control includes the pulse width control of a driving pulse for driving the exposure device 12 and an exposure intensity control.

The development control includes the DC component voltage control of the development bias, AC component voltage control of the development bias, AC component frequency control, and developer carrier moving speed control.

In the image forming apparatus for forming a color image in FIG. 1, a patch image of each of Y, M, C, and K is formed on the intermediate transfer member 1, and the control section 20 controls the image quality control of each of the image forming sections 2Y, 2M, 2C, and 2K.

FIG. 1 shows an example of the image forming apparatus for forming a color image. This apparatus can be an image forming apparatus for forming a monochromatic image.

Further, this apparatus can be an image forming apparatus that does not use an intermediate transfer member. To be more specific it can be an image forming apparatus that forms a toner image on the photoreceptor as an image carrier, and transfers the toner image from the photoreceptor to a recording medium, whereby an image is formed.

Figure 3:
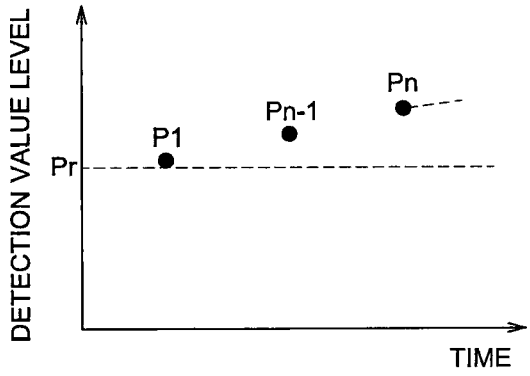
FIG. 3 is a diagram representing the model of changes in density detected by a density sensor 24.

FIG. 3 shows the model of changes in density detected by a density sensor 24.

The detection values P1, P2 . . . Pn of the density sensor having detected a patch image do not always agree with the reference value Pr.

In the image quality control process, image forming conditions are controlled in such a way that the detection value of the density sensor having detected a patch image agrees with the reference value Pr or comes close to the reference value Pr.

To take an example from the development control that controls the development bias, the following describes the image quality control.

As will be described below, the image quality control corrects the image forming conditions in terms of the first or the second correction amount.

The image quality control is executed for every formation of a predetermined sheet of image.

In the example described below, a predetermined level of image quality is maintained by the aforementioned image quality control that is executed for every fifty printing operations.

<First Correction Amount>

A patch image is formed on the intermediate transfer member 1 and the density of the patch image is detected by the density sensor 24. The detection values P1, P2 . . . Pn for the density of the patch image detected for every fifty printing operations are stored in a detection value storage device 27.

As illustrated, the detection values P1 through Pn of the patch image density do not always agree with the reference value Pr and they sometimes deviate from the reference value Pr.

Based on the output of the density sensor 24, the control section 20 calculates the first correction amount and corrects the DC component Vdc of the development bias by the first correction amount, whereby the corrected DC component Vdc is set.

To be more specific, the control section 20 provides correction according to the following formula (1):

$$Vdc(k)=Vdc(k-1)+\Delta Vdc \quad (1)$$

The first correction amount ΔVdc with respect to the DC component Vdc of the development bias is calculated according to the following formula (2):

$$\Delta Vdc=(Pr-Pk)\times\alpha 1 \quad (2)$$

In formulae (1) and (2), "Pr" denotes a reference value, "k" indicates a desired natural number out of 1, 2, . . . n, and a1 represents the coefficient determined by the DC component Vdc at the time of formation of a patch image. For example, α1 is given by:

$$\alpha 1=0.256\times Vdc-37.533.$$

As described above, the first correction amount corresponds to the difference between the reference value and density sensor output. The correction amount is preferably proportional to the difference between them.

For example, when Pk=7.7V, Pr=8.0V, Vdc=400V, α=65, calculation is performed to get:

$$\Delta Vdc=(8.0-7.7)\times 65=19V$$

<Second Correction Amount>

Theoretically, the aforementioned image quality control should provide the image of a predetermined density. To put it another way, it should provide a predetermined level of output density in response to a predetermined level of input density.

However, the coverage of the formed image may be subjected to a change or the development property may be subjected to a chronological change due to changes in the environment (temperature or humidity), whereby a predetermined density image cannot be obtained in some cases.

Such a change in image density leads to deterioration of the image quality.

The present invention corrects the aforementioned changes in image density according to the following procedure thereby forming an image of a predetermined density.

In the second correction mode, the DC component Vdc is corrected by the second correction amount ΔVdc shown in the following formula (3):

$$\Delta Vdc=(Pr-Pk)\times\alpha 2 \quad (3)$$

wherein α2=α1×β

The coefficient β is calculated from the detection value of the density sensor.

The calculation example of the coefficient β is given by the following formula (4):

$$\beta=0.8\times|Pk-P(k-1)|+1.1 \quad (4)$$

Coefficient β is greater than 1, as shown in formula (4). This implies α2>α1 and the second correction amount is greater than the corresponding first correction amount in terms of absolute value.

"Corresponding of" the corresponding first correction amount in the sense in which it is used here refers to the relationship between the first correction amount and the second correction amount calculated from the same density detection value.

Pk=8.8V, P (k−1)=8.4V, Pr=8.0V, β=0.8×|8.8−8.4|+1.1=1.42, and α2=65×1.42=92 when Vdc=400V is assumed at the time of creating a patch image for getting the detection value Pk. Thus, correction amount ΔVdc=−74V.

The following shows the calculation example 2 of coefficient β:

When β=0.8×|(P1+P2+ . . . Pn)/n−Pr|+1.03, P2=8.8V, P1=8.4V, Pr=8.0V and n=2 are assumed, the following is obtained:

β=0.8×|(8.8+8.4)/2−8.0|+1.03=1.51, α2=65×1.51=98. Thus, correction amount ΔVdc=(8.8−8.0)×98=−79V.

Figure 4:
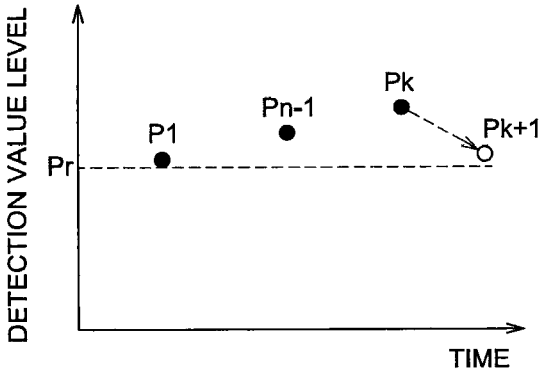
FIGS. 4 (*a*) and 4 (*b*) are charts representing a concept for correction.
Figure 4:
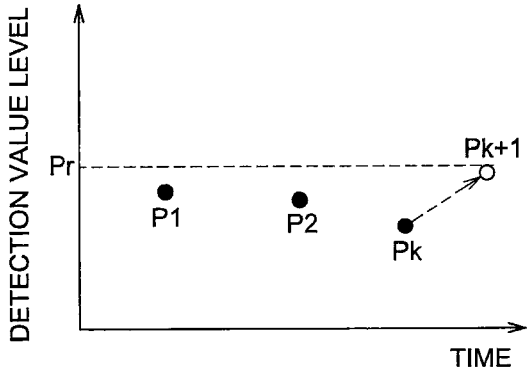

FIG. 4 represents a concept of the aforementioned correction.

When the detection value changes from P1 to Pk, correction is made after detection value Pk, whereby the following detection value Pk+1 assumes a value almost equal to the reference value Pr, as shown by the white circles in (a) and (b) of FIG. 4.

As can been seen from the fact that the coefficient α2 used in the calculation of the second correction amount is greater than the coefficient α1 used in the calculation of the first correction amount, the absolute value of the second correction amount is greater than the absolute value of the first correction amount.

The result of density correction shown in FIG. 4 has been obtained from calculation. Not only that, this result has been verified by detecting the density of the patch image having actually been formed.

When the first or second correction amount is used for correction, the image density may change if the correction amount is excessive. Thus, it is preferable to set upper limits to the first and second correction amounts.

<Correction Mode Control>

The following describes the difference in usage of the first correction mode using the first correction amount and the second correction mode using the second correction amount.

When the density of the patch image formed on the image carrier is detected by the density sensor 24 before and after in a time base, and the detection value tends to increase or decrease with respect to the order of sampling, the control section 20 corrects the image forming conditions in the second correction mode using the second correction amount. If the detection value does not tend to increase or decrease, the image forming conditions are corrected in the first correction mode using the first correction amount.

The fact that the detection value tends to increase or decrease means that the following logical formula (5) is met:

$$\text{Tends to increase or decrease}=\text{Condition A, Condition B, Condition C, or Condition D} \quad (5)$$

Condition A: Pn>Pn−1> . . . P2>P1 (equivalent to a gradual increase)

Condition B: P1>P2 . . . Pn−1>Pn (equivalent to a gradual decrease)

Condition C: P1, P2 . . . Pn inclination of approximate straight line of Pn θ>θ0

Condition D: P1, P2 . . . inclination of approximate straight line of Pn θ<−θ0

Here θ0 denotes a predetermined inclination angle nearly horizontal. The approximate straight line refers to the approximate straight line with respect to "n" density detection values wherein "n" denotes a predetermined number, and can be obtained by the method of least square or other appropriate calculation method.

Figure 5:
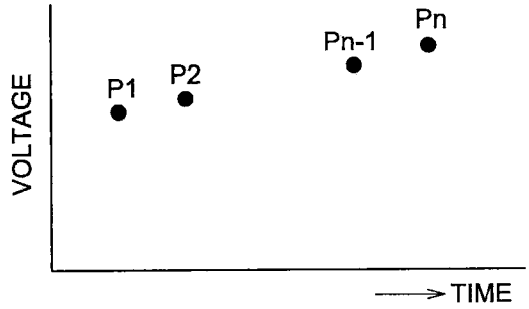
FIGS. 5(*a*) to 5 (*d*) are charts representing a concept for increasing or decreasing the tendency of detection values.
Figure 5:
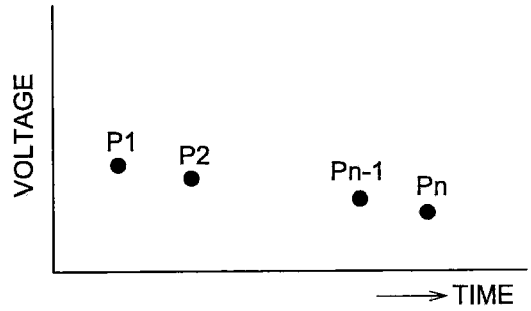
Figure 5:
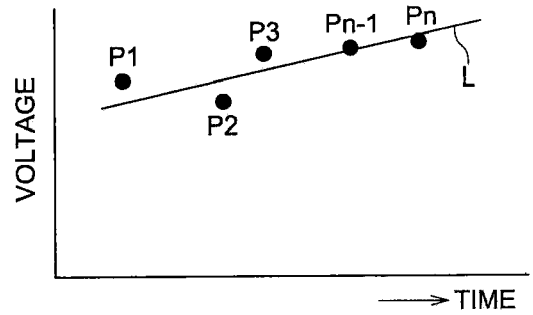
Figure 5:
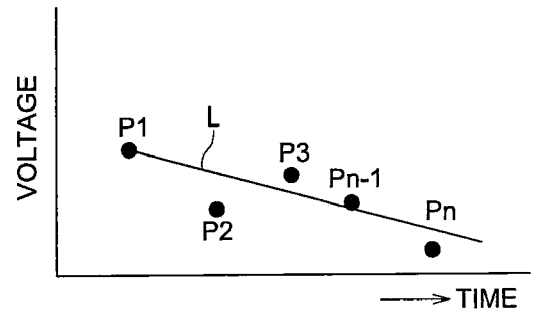

FIG. 5 shows a concept of Conditions A through D. FIG. 5 (*a*) indicates the Condition A, FIG. 5 (*b*) shows the Condition B, FIG. 5 (*c*) represents the Condition C, and FIG. 5 (*d*) shows the Condition D. It should be noted that the aforementioned inclination θ indicates the inclination of the approximate straight line L of FIGS. 5 (*c*) and (d).

Figure 6:
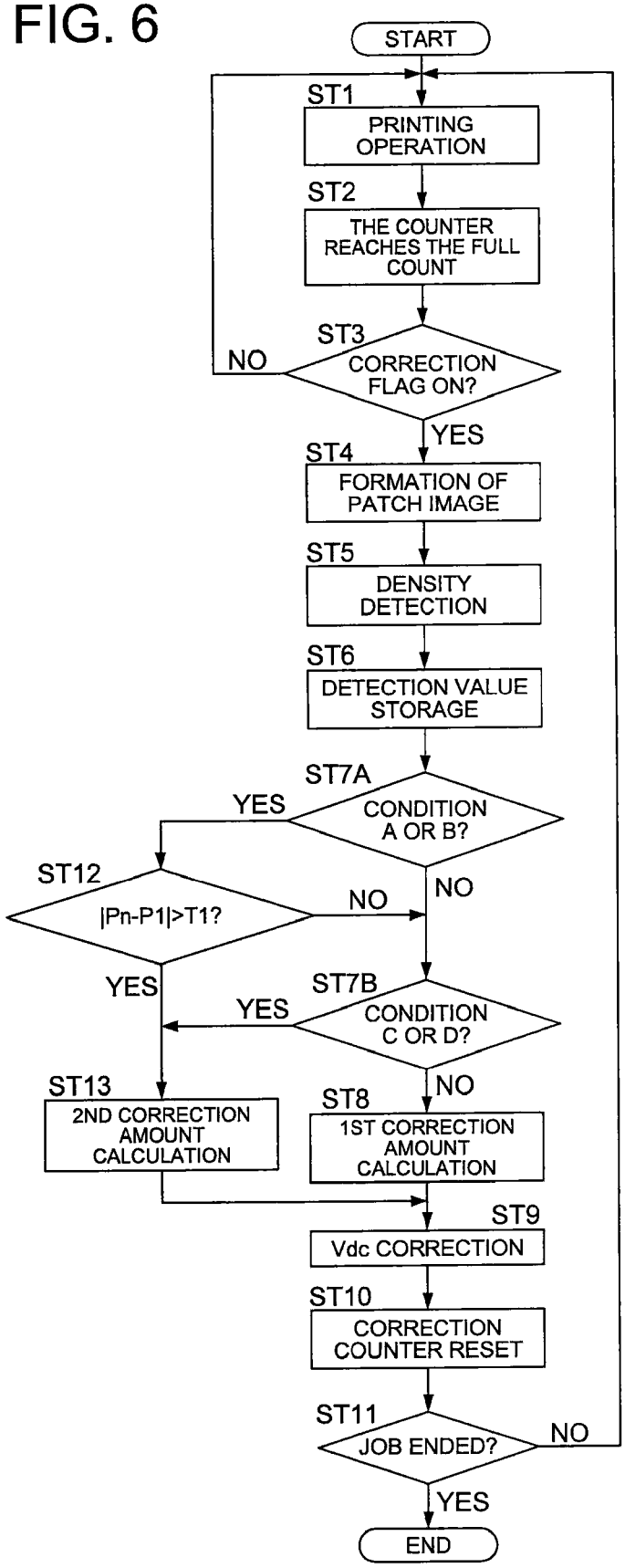
FIG. 6 is a chart representing a flow chart showing an example of control wherein the first and second correction modes are selected.

FIG. 6 is a flow chart showing the image forming condition setting process in conformity to the logical formula (5).

With the start of image formation (printing operation) in Step ST1, a step is taken to count the sheets with image formed thereon in Step ST2.

The patch image for image quality control is formed (Step ST4) when a predetermined number of sheets (e.g., 50 sheets) are worked out in Step ST3.

The patch image density is detected by the density sensor 24 in Step ST5, and the detection value is stored in the detection value storage device 27 in Step 6.

In Step ST7A, a step is taken to determine whether or not the detection values P1 through Pn meet the Condition A: Pn>Pn−1> . . . P2>P1 or Condition B: P1>P2 . . . Pn−1>Pn.

If the decision of ST7A is "No", a step is taken in Step ST7B to determine whether or not P1 through Pn meet the Condition C: P1, P2 . . . inclination of approximate straight line of Pn θ>θ0, or Condition D: P1, P2 . . . inclination of approximate straight line of Pn θ<−θ0.

Step ST7A and Step 7B indicate the decision to see if the detection value tends to increase or decrease.

The decision in Step ST7A and ST7B is made on the most updated predetermined number, "n" of the detection values stored in the detection value storage device 27.

If the decision of Step ST7A is "No" and the decision in Step 7B is "No", the first correction amount is calculated in Step 8.

If the decision of Step ST7A is "Yes", the absolute value of the difference between the detection value Pn as the final detection value and the first detection value P1 is compared with a predetermined threshold value T1 in Step ST12. "n" indicates the sampling number of the detection values when an increasing or decreasing tendency is determined. The detection value Pn is the final one of the detection values stored in the detection value storage device 27. Further, the P1 is the first one of the detection values stored in the detection value storage device 27.

If the absolute value |Pn−P1| is equal to or less than the threshold value T1 (ST12: No), the system goes to Step ST8.

As described above, when there is a small difference between the detection value Pn and reference value Pr, the first correction amount is selected independently of the tendency to increase or decrease, whereby higher-precision control is enabled.

In Step ST12, if the absolute value of the difference between the detection value Pn and reference value Pr is greater than the threshold value T1 (ST12: Yes);

$$\Delta Vdc=(Pr-Pk)\times\alpha 2. \qquad \text{Formula (2)}$$

Thus, the correction value ΔVdc of the development bias as the second correction amount is calculated (ST13).

The development bias Vdc having been corrected in conformity to the first correction amount calculated in Step ST8 or the second correction amount calculated in Step ST13 is set in Step ST9. Then the sheet counter is reset (ST19 and 10).

A loop of Steps ST1 through ST10 is repeated and the procedure terminates at the end of the job (ST11).

According to the aforementioned image forming apparatus of the present embodiment, the fluctuation in density due to correction insufficiency is effectively avoided without frequent occurrence of correction insufficiency, even when there is a specific tendency in the fluctuation of image characteristics or when the fluctuation is greater, whereby stable formation of a high-quality image is ensured.

What is claimed is:

1. An image forming apparatus comprising: an image carrier;

an image forming section which forms a toner image onto the image carrier;

a sensor which detects a density of a patch image which is formed on the image carrier;

an image quality control section which controls an image forming condition based on a detection value of the sensor; and a judging section which judges whether the detection value of the sensor has a tendency of increasing or decreasing with a passage of time by determining whether each detection value is higher than a previous detection value, or by determining whether each detection value is lower than the previous detection value, or by determining the tendency of increasing or decreasing based on a plurality of detection values with the passage of time when an inclination of an approximately straight line fit to the plural detection values is different from an inclination of an approximately horizontal line;

wherein, the image quality control section compensates the image forming condition with a first compensating coefficient representing a ratio of a difference between the detection value and a reference value to a compensation amount in a case when the judging section judges that the detection value does not have the tendency of increasing nor decreasing, and compensates the image forming condition with a second compensating coefficient of which absolute value is larger than an absolute value of the first compensating coefficient corresponding to the second compensating coefficient, in a case when the judging section judges that the detection value has the tendency of increasing or decreasing.

2. The image forming apparatus described in claim 1, wherein the judging section judges if a difference between a first detection value and a final detection value of the sensor is larger than a predetermined value or not, and the image quality control section compensates the image forming condition with the second compensating coefficient in the case when it is judged that the difference is larger than the predetermined value.

3. The image forming apparatus described in claim 1, wherein the judging section judges if detection values have a tendency of increasing or the tendency of decreasing, or not, based on an inclination of an approximate straight line of the detection values.

4. The image forming apparatus described in claim 3, wherein the image quality control section compensates the image forming condition with the second compensating coefficient in the case when the inclination of the approximate straight line is larger than a predetermined inclination.

5. The image forming apparatus described in claim 1, wherein each of the first compensating coefficient and the second compensating coefficient has an upper limit value.

6. The image forming apparatus described in claim 1, wherein the first compensating coefficient represents an appropriate compensating coefficient based on the detection value of the sensor at a time of the detection and the second compensating coefficient represents a compensating coefficient for preventing a density change caused by a shortage of a compensating caused by the tendency of increasing or decreasing.

7. An image quality control method of an image forming apparatus comprising an image carrier and an image forming section which forms a toner image onto the image carrier, the image quality control method comprising:

forming a patch image on the image carrier;

detecting a density of the patch image;

controlling an image forming condition based on a detection value of a sensor;

judging if the detection value of the sensor has a tendency of increasing or a tendency of decreasing with a passage of time by determining whether each detection value is higher than a previous detection value, or by determining whether each detection value is lower than the previous detection value, or, or by determining the tendency of increasing or decreasing based on a plurality of detection values with the passage of time when an inclination of an approximately straight line fit to the plural detection values is different from an inclination of an approximately horizontal line; and compensating the image forming condition with a first compensating coefficient representing a ratio of a difference between the detection value and a reference value to a compensation amount in a case when it is judged that the detection value does not have the tendency of increasing nor the tendency of decreasing, and compensates the image forming condition with a second compensating coefficient which has a larger absolute value than the first compensating coefficient, in a case when it is judged that the detection value has the tendency of increasing or the tendency of decreasing.

8. The image quality control method described in claim 7, comprising:

judging if a difference between a first detection value and a final detection value of the sensor is larger than a predetermined value or not; and compensating the image forming condition with the second compensating coefficient in the case when it is judged that the difference is larger than the predetermined value.

9. The image quality control method described in claim 7, comprising the judging if detection values have a tendency of increasing or a tendency of decreasing, or not, based on the an inclination of an approximate straight line of the detection values.

10. The image quality control method described in claim 9, comprising the compensating the image forming condition with the second compensating coefficient in the case when the inclination of the approximate straight line is larger than a predetermined inclination.

11. The image quality control method described in claim 7, wherein each of the first compensating coefficient and the second compensating coefficient has an upper limit value.

12. The image quality control method in claim 7, wherein the first compensating coefficient represents an appropriate compensating coefficient based on the detection value of the sensor at a time of the detection and the second compensating coefficient represents a compensating coefficient for preventing a density change caused by a shortage of a compensating caused by the tendency of increasing or decreasing.

13. An image forming apparatus comprising: an image carrier;

an image forming section which forms a toner image onto the image carrier;

a sensor which detects a density of a patch image which is formed on the image carrier;

an image quality control section which controls an image forming condition based on a detection value of the sensor; and a judging section which judges whether the detection value of the sensor has a tendency of increasing or decreasing with a passage of time by determining whether each detection value is higher than a previous detection value, or by determining whether each detection value is lower than the previous detection value, or by determining that an inclination of an approximately straight line fit to the plural detection values is different from an inclination of an approximately horizontal line;

wherein, the image quality control section compensates the image forming condition with a first compensating coefficient representing a ratio of a difference between the detection value and a reference value to a compensation amount in a case when the judging section judges that the detection value does not have the tendency of increasing nor decreasing, and compensates the image forming condition with a second compensating coefficient of which absolute value is larger than an absolute value of the first compensating coefficient corresponding to the second compensating coefficient, in a case when the judging section judges that the detection value has the tendency of increasing or decreasing.

14. An image quality control method of an image forming apparatus comprising an image carrier and an image forming section which forms a toner image onto the image carrier, the image quality control method comprising:

forming a patch image on the image carrier;

detecting a density of the patch image;

controlling an image forming condition based on a detection value of a sensor;

judging if the detection value of the sensor has a tendency of increasing or a tendency of decreasing with a passage of time by determining whether each detection value is higher than a previous detection value, or by determining whether each detection value is lower than a the previous detection value, or by determining that an inclination of an approximately straight line fit to the plural detection values is different from an inclination of an approximately horizontal line; and compensating the image forming condition with a first compensating coefficient representing a ratio of a difference between the detection value and a reference value to a compensation amount in a case when it is judged that the detection value does not have the tendency of increasing nor the tendency of decreasing, and compensates the image forming condition with a second compensating coefficient which has a larger absolute value than the first compensating coefficient, in a case when it is judged that the detection value has the tendency of increasing or the tendency of decreasing.

* * * * *